United States Patent [19]

Godin et al.

[11] 4,043,234

[45] Aug. 23, 1977

[54] APPARATUS AND METHOD FOR CUTTING CIRCLES FROM SHEET MATERIAL

[75] Inventors: Victor B. Godin, Reading; Howard P. Bruck, Westford, both of Mass.

[73] Assignee: Victor B. Godin, Trustee, Reading, Mass.

[21] Appl. No.: 744,524

[22] Filed: Nov. 24, 1976

[51] Int. Cl.[2] ..... B26D 9/00; B26F 1/44

[52] U.S. Cl. ..... 83/40; 83/50; 83/55; 83/405; 83/620; 83/691

[58] Field of Search ..... 83/40, 50, 55, 405, 83/620, 687, 691

[56] References Cited

U.S. PATENT DOCUMENTS

| | | | |
|---|---|---|---|
| 605,334 | 6/1898 | Painter | 83/620 X |
| 653,955 | 7/1900 | Gordon | 83/687 X |
| 1,439,393 | 12/1922 | Assmann, Jr. | 83/50 |
| 2,489,583 | 11/1949 | Messenger | 83/50 |

FOREIGN PATENT DOCUMENTS

| | | | |
|---|---|---|---|
| 2,165,209 | 8/1973 | France | 83/50 |

*Primary Examiner*—Frank T. Yost

*Attorney, Agent, or Firm*—Pearson & Pearson

[57] ABSTRACT

To avoid the waste of die-cutting a plurality of circular blanks of identical diameter from rectangular sheet material, the material is formed into non-rectangular sheets of parallelogram trapezoid, or equilateral triangle configuration, which have a predetermined length and width substantially equal to a multiple of the diameter of the circles. The circular dies of a gang-die cutter are juxtaposed in a series of laterally extending rows in parallelism, longitudinally of the die cutter, the rows being at an angle of 60° to the longitudinal edges of the sheets. The sheets and the die pattern thus both are of parallelogram trapezoid, or equilateral triangle, outline.

8 Claims, 7 Drawing Figures

Fig. 1.
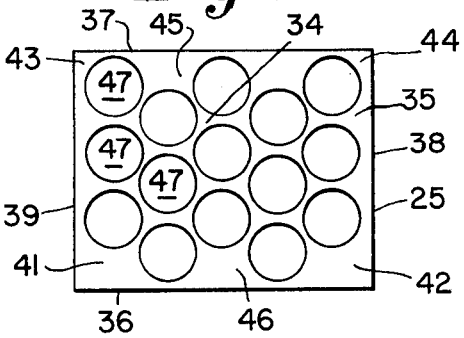
Fig. 2.
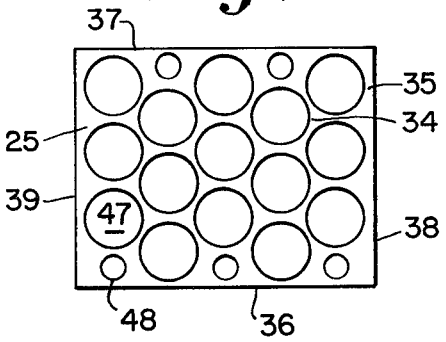
Fig. 3.
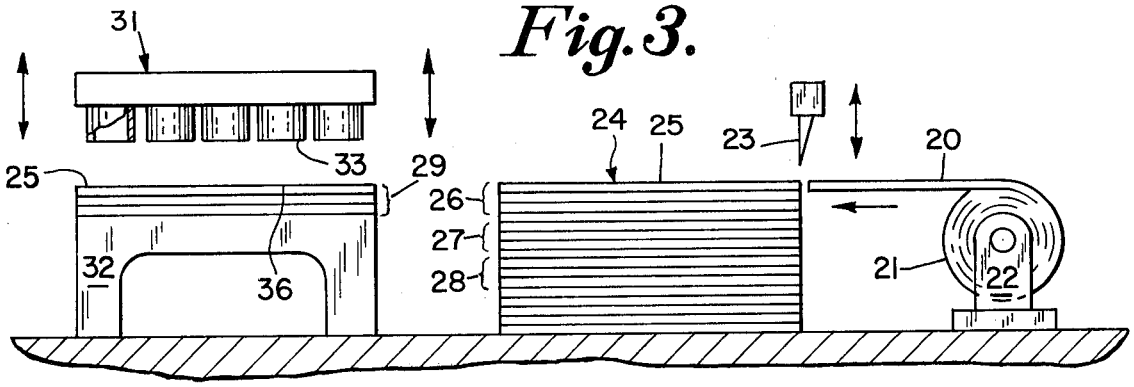
Fig. 4.
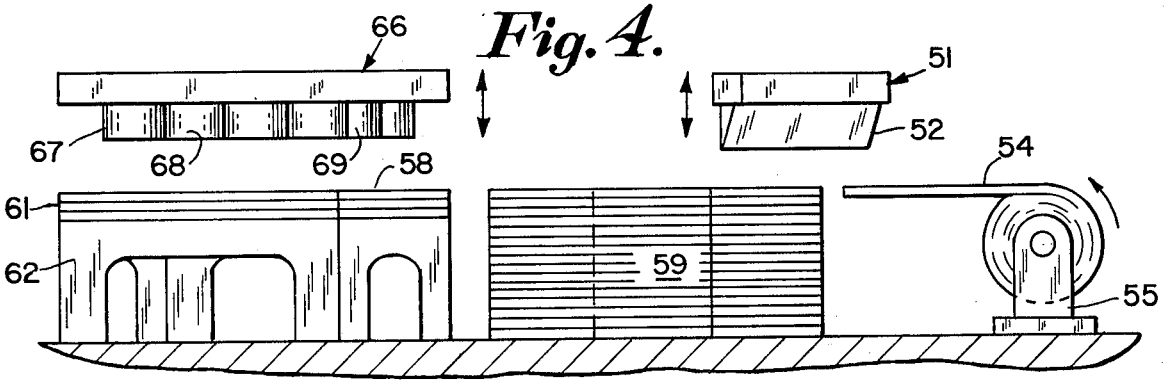
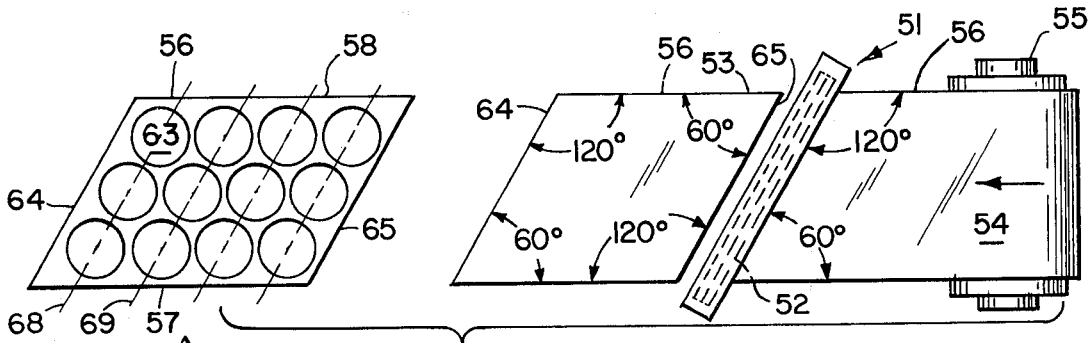
Fig. 5.
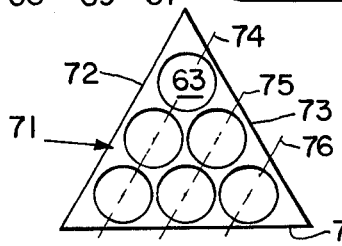
Fig. 6.
Fig. 7.
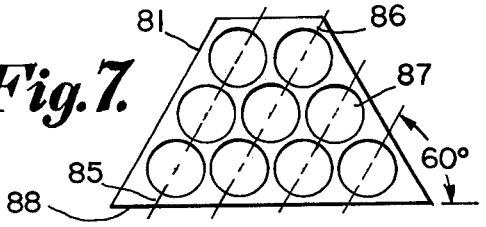

APPARATUS AND METHOD FOR CUTTING CIRCLES FROM SHEET MATERIAL

BACKGROUND OF THE INVENTION

In many industrial processes it is necessary to form circular blanks from sheet material, for example; to form circular blanks of paper to be formed into paper cups, or to cut circles of metal, fabric, etc. for other purposes. The objective must obviously be to position the circular cuts on the sheet so that the maximum amount of material is utilized and so that there is minimum waste of sheet material. Some manufacturers cut circles for sheet stock and other cut circles directly from roll stock.

The prior art, as far as we are aware, while occasionally seeking to stamp, or cut, a plurality of circles outlining a rectangle, with the lateral, aligned rows normal to the longitudinal edges of the sheet, and in parallelism, from a continuous web having parallel longitudinal side edges has conventionally and normally sought to cut such a rectangular pattern of rows of circle s from lifts of superposed rectangular sheets by a suitable gang die cutter. The term "gang die cutter" means a die block containing one or more cutting heads, cutting dies, or the like for simultaneous cutting.

The efficiency of such a cutting pattern can be measured by computing the ratio of the amount of raw sheet material utilized in the circles themselves divided by the total raw material of the original sheet.

$$\text{raw material utilization} = \frac{\text{area of all circles cut from sheet}}{\text{area of original sheet}}$$

Waste is defined as 100% minus raw material utilization.

In order to improve material utilization and thereby reduce waste, some manufactures cutting several sizes of circles from rectangular sheets, or webs, have attempted to group several sizes of circles on one rectangular sheet. While this can usually be shown to be an improvement in utilization over a rectangular pattern from which only circles of identical diameter are cut, it involves special collection and handling operations thereby iincreasing cost while reducing waste only slightly.

In U.S. Pat. No. 126,812 to James of May 14, 1872 a method for cutting soles from a side of leather is disclosed. The patentee improves over his prior art by arranging lateral rows of identical soles normal to the longitudinal edges of the pattern; by reversal of toe and heel in alternate longitudinal rows, and by cutting off a portion of each heel to achieve superior economy of material. Mutilation of the circles would not be a successful solution to the problem of maximum production of identical circles from rectangular sheets.

We are aware that angular sheet cutter apparatus is commercially available which can cut square, rectangular or parallelogram shaped sheets. For example, a "Beck Angular Sheet Cutter" made by Charles Beck Machine Corporation of Church Road, King of Prussia, Pa. However, the cutter of such apparatus is normally angularly adjustable only up to 22°, which angle would not be satisfactory for the sheets of this invention.

SUMMARY OF THE INVENTION

In this invention, a method and apparatus for cutting circles from sheet stock of any material is provided, which is capable of reducing waste percentages in a considerable amount, depending on the required trim between circles, the size of the orginial sheets and the size of the circles to be cut. The invention is especially beneficial to a manufacturer who:

1. cuts large numbers of circles from sheets of raw material.
2. currently has percentages above 20%
3. cannot inexpensively convert his waste into reusable raw material.

In general the invention consists in abandoning the rectangular sheet concept of the prior art and, instead, cutting the raw sheet material to form parallelograms, trapezoids, or equilateral triangles of predetermined lateral dimensions which are substantially a multiple of the diameter of the identical circles to be cut from the sheet plus trim. Preferably the longitudinal dimension of the sheet is predetermined also as subtantially a multiple of the diameter of the identical circles to be cut from the sheet plus trim.

The invention also contemplates the provision of a gang, or block, type die cutter having a plurality of laterally extending, juxtaposed rows of circular die cutters, of identical diameter arranged longitudinally therealong, the rows being each in rectilinear alignment at an angle of 60° to one longitudinal edge of the block and of the sheets to be cut. The die cutter thus form a parallelogram outline in which the obtuse angles are 120° and the acute angles are 60°.

While not preferred, a considerable saving is also achieved with sheets in the form of an equilateral triangle wherein all acute angles are about 60°, or with sheets in the form of a trapezoid having acute angles of about 60°.

Preferably the die cutters of the invention reciprocate vertically to simultaneously cut a parallelogram pattern of identical circles form a lift of a plurality of parallelogram-shaped, superposed, flat, sheets.

BRIEF DESCRIPTION OF THE DRAWING

FIG. 1 is a plan view of a rectangular sheet with circles of identical diameter cut therefrom, in the manner now practiced in the industry.

FIG. 2 is plan view of a rectangular sheet with circles of different diameter cut therefrom as sometimes practiced in the industry in an effort to reduce waste.

FIG. 3 is a schematic, side elevation of a conventional sheet cutter and gang die cutter as now used in the industry.

FIG. 4 is a schematic side elevation, showing the apparatus and method of the invention.

FIG. 5 is a plan view of the apparatus shown in FIG. 4.

FIG. 6 is a plan view of an equilateral triangle sheet cut with identical circles in accordance with the invention; and FIG. 7 is a view similar to FIG. 6 of a trapezoid cut with identical circles.

DESCRIPTION OF A PREFERRED EMBODIMENT

To understand the reduction in waste of our invention it is necessary to visually compare it with the prior apparatus and methods conventionally used in industry to cut circles from sheets. In FIGS. 1–3, therefore a continuous web of sheet material 20 is fed from a supply roll 21 on a roll stand 22 to a vertically reciprocating cutter 23 which creates a stack 24 of superposed, flat sheets 25 divided into lifts 26, 27, 28, 29, etc. The cutter 23 extends normal to the longitudinal edges of the web 20 so that the sheets 25 are of rectangular configuration.

A gang, or block, die cutter 31 is mounted to repciprocate vertically above the cutter table 32, and includes a plurality of circular cutting dies such as 33, juxtaposed to each other and as closely packed as possible depending on the required trim 34 between the circles 33 and the required trim 35 between the circles 33 and the longitudinal edges 36, 37 and lateral edges 38, 39 of the sheets 25.

The relatively large areas of waste material 41, 42, 43 and 44 at the 90° angle corners of the sheets 25 should be noted, as well as the areas of waste 45 and 46 at the extremity of each row of circles.

In an effort to reduce this costly waste area, some manufactures have resorted to laying out the rectangular sheets 25, as shown in FIG. 3, with identical large circles 47 and with the waste spaces occupied by smaller identical circles 48, but this requires separating out the stacks of small circles and still results in considerable waste of raw sheet material.

As shown in FIGS. 4–6 the apparatus and method of this invention includes the cutting means 51, which may be a rotary cutter but preferably is a guillotine type cutter 52, mounted for recipricatory movement alongside the path 53 of a continuous web 54, supplied from a roll stand 55. However, unlike the knife 23, the knife 52 is positioned at an angle of about 60° from the longitudinal edge 56, an about 120° from the longitudinal edge 57, of the web 54.

The elongated sheet material 54 is thus formed into a plurality of flat sheets 58 of parallelogram outline, which are stacked as at 59 and movable singly, or in lifts 61 of suitable thickness individually and successively onto the table 62.

The parallogram shaped sheets 58 have a predetermined width, which preferably is a multiple of the diameter of the identical circles 63 to be cut therefrom plus normal trim. The length of the parallelogram shaped sheets 58 may be as desired, but preferably the distance between the laterally extending edges 64 and 65 is also a multiple of the diameter of the identical circles 63 to be cut therefrom plus normal trim.

The parallelogram shaped sheets 58 thus have a pair of 60° acute angles and a pair of 120° obtuse angles.

In cooperation with the parallelogram shaped flat sheets 58, the gang, or block die cutting means 66 is provided, means 66 including a plurality of circular die heads, or die cutters 67 arranged also in parallelogram arrangement, the parallelogram pattern having an overall width and length which is a multiple of the diameter of the identical circles to be cut thereby plus trim space, and the die cutters being juxtaposed in close packed arrangement. The die cutters 67 is rectilinearly aligned in laterally extending rows such as 68 and 69, the rows being in parallelism with each other and each row being at an angle of 60° from a longitudinal edge 57 of a sheet 58.

As indicated in FIG. 6, sheets 71 of equilateral triangle configuration could be used to carry out the concept of the invention by means of a pair of knives such as 52 angularly related to each other to cut the lateral edges 72 and 73 of the sheets 71. The gang die cutters are arranged in laterally extending rows 74, 75 and 76 of identical circles 63, each at an angle of 60° from the longitudinal edge 77 so that there are three acute angles of 60° on each sheet 71.

It has been found that the further away from a sixty degree angle towards, or away from, a ninety degree angle, the laterally extending edges of the sheets are inclined the worse the waste percentage becomes. While we specify sixty degrees as the preferred angle herein, it should be understood that angles of about, or approximately, 60° are intended to be included within the scope hereof.

As indicated in FIG. 7, sheets 81 trapezoid configuration, and preferably of isoceles trapezoid configuration may also be used to carry out the concept of the invention, together with similarly configured die cutters, to form a plurality of longitudinally arranged laterally extending rows such as 85 and 86 of identical circles 87, each row at an angle of about 60° from a longitudinal edge 88.

Similarly it will be understood that some manufactures by reason of cutting machine restrictions or sheet supply conditions, will not always be able to satisfy the optimum condition of having both width and length of sheets be an exact multiple of circle diameter plus trim. Regardless of such variation from the optimum, the 60° slanted cut sheets and 60° slanted rows of cutters of our invention will still produce a substantial saving in sheet material.

The magnitude of the yearly savings to a manufacturer in using the apparatus and method of this invention can be understood by a typical example in which 600 tons of paper are processed each month at a cost of about $450/ton. The yearly waste under conventional procedure of the prior art (neglecting the small salvage value of the scrap) is often about 28%.

600 Tons at $450/ton/month × 12 months × 28% = $907,200

Utilizing the technique of this invention, will cause the waste percentage to drop to about 18% so that the yearly waste becomes 600 Tons at $450/ton/month × 12 months × 18% = $583,200

A yearly saving of $324,000 thus achieved indicates the importance of the invention in industry.

We claim:

1. The method of cutting a plurality of circles of identical diameter from elongated sheets by means of a gang type die cutter, said method comprising the steps of providing a plurality of said elongated sheets, each with a pair of longitudinal edges at a predetermined width apart and a pair of lateral edges each at a predetermined length apart, said predetermined width and length being substantially an exact multiple of the diameter of said circles plus trim, the lateral edges of each said sheet defining an acute angle of about sixty degrees with a longitudinal edge thereof to form the outline of said sheet into parallelogram, trapezoid, or equilateral triangle, configuration;

arranging the circular dies of said gang type die cutter in closely packed, laterally extending rows, juxtaposed successively lengthwise of said cutter, the centres of each successive lateral row of said circular dies being aligned at an acute angle of about sixty degrees from a longitudinal edge of said cutter and the overall width and length of said rows of cutters being substantially an exact multiple of the diameter of said circles plus trim spacing;

and then individually and successively die cutting lifts of superposed said sheets by means of said cutter to simultaneously form a plurality of circles of identical diameter with minimum waste.

2. A method as specified in claim 1 wherein:

said step of providing said sheets includes the steps of cutting the opposite laterally extending edges of each sheet in parallelism to form parallograms with a pair of acute opposite corner angles of 60°, and a pair of obtuse opposite corner angles of about 120°.

3. A method as specified in claim 1 wherein;

said step of providing said sheets includes the step of cutting the opposite laterally extending edges of each sheet in angular relationship to each other to form equilateral triangles with all three interior angles at about 60°.

4. Apparatus for cutting a plurality of circles of identical diameter from elongated sheet material of predetermined width and length which comprises means for cutting at least one said sheet to form a pair of longitudinal edges spaced said predetermined width apart and a pair of lateral edges spaced said predetermined length apart, said lateral edges being at an angle of about 60° to at least one of said longitudinal edges and means for simultaneously cutting a plurality of circles of identical diameter from said sheet, said means including a gang die cutter with a plurality of juxtaposed, circular cutting dies extending thereover, said dies being arranged longitudinally in a series of rectilinearly aligned, laterally extending rows of dies, each row being in parallelism with said lateral edges of said sheets.

5. The method of cutting a plurality of circles of identical diameter from a plurality of superposed flat sheets by means of a cutter having a plurality of identical circular dies which comprises the steps of cutting said sheets to a predetermined length and width, said dimensions being substantially a multiple of said diameter and with one pair of opposite edges of said sheets at substantially a 60° angle to one of the other pair of opposite edges:

then cutting a plurality of said circles simultaneously from a lift of said superposed sheets with said plurality of identical circular dies of said cutter juxtaposed in close packed relation in an overall pattern conforming to the configuration of said sheets;

6. A method as specified in claim 5 wherein;

the step of cutting said sheets includes the step of cutting said one pair of opposite edges in parallelism with each other to configure said sheets as parallelograms.

7. A method as specified in claim 5 wherein;

the step of cutting said sheets includes the step of cutting said one pair of edges in an angular relation to each other to configure said sheets as trapezoids or equilateral triangles.

8. Apparatus for cutting a plurality of circles of identical diameter from sheet material with minimum waste said cutter comprising a cutter of predetermined length and width, said dimensions being each substantially a multiple of said diameter plus trim space, said cutter having a plurality of laterally extending rows of juxtaposed, circular dies arranged longitudinally therealong. said rows being in parallelism with each other and being at an angle of about 60° from a longitudinal edge of said cutter to form an overall parallelogram pattern of circular cutters, said parallelogram having a pair of acute angles of about 60° and a pair of obtuse angles of about 120°.

* * * * *